US007762966B1

(12) United States Patent
Gaines

(10) Patent No.: US 7,762,966 B1
(45) Date of Patent: Jul. 27, 2010

(54) MASSAGING MATTRESS ASSEMBLY

(76) Inventor: Delores Gaines, 2625 Highland Ave. South, Apt.#305, Birmingham, AL (US) 35205

( * ) Notice: Subject to any disclaimer, the term of this patent is extended or adjusted under 35 U.S.C. 154(b) by 1140 days.

(21) Appl. No.: 11/372,774

(22) Filed: Mar. 13, 2006

(51) Int. Cl.
*A61H 1/00* (2006.01)

(52) U.S. Cl. ..... 601/46; 601/84; 601/128; 601/131

(58) Field of Classification Search ..... 601/102, 601/103, 24, 57, 51, 52, 58, 98, 99, 100, 601/101, 115, 49, 56, 112, 113, 118, 122, 601/128, 134, 84, 46, 131
See application file for complete search history.

(56) References Cited

U.S. PATENT DOCUMENTS

| | | | | |
|---|---|---|---|---|
| 1,539,299 | A | 3/1923 | Cheney | |
| 4,169,466 | A | 10/1979 | Wong | |
| 4,233,966 | A | 11/1980 | Takahashi | |
| 5,416,936 | A | 5/1995 | Chan | |
| 5,542,907 | A * | 8/1996 | Chou | 601/46 |
| 5,752,742 | A * | 5/1998 | Kerner et al. | 297/391 |
| 5,836,900 | A * | 11/1998 | Leventhal | 601/57 |
| 5,913,839 | A | 6/1999 | Wincek | |
| D428,996 | S | 8/2000 | Gonzales | |
| 6,182,313 | B1 * | 2/2001 | Eschenbach | 5/640 |
| 6,883,870 | B2 * | 4/2005 | Jost | 297/391 |
| 2002/0111570 | A1 * | 8/2002 | Cutler et al. | 601/15 |
| 2003/0212352 | A1 * | 11/2003 | Kahn | 601/98 |
| 2004/0147959 | A1 | 7/2004 | Shin | |
| 2005/0070826 | A1 * | 3/2005 | Hsiao | 601/57 |
| 2005/0187498 | A1 * | 8/2005 | Miller | 601/72 |
| 2007/0032752 | A1 * | 2/2007 | Wu | 601/57 |

* cited by examiner

*Primary Examiner*—Justine R Yu
*Assistant Examiner*—Colin Stuart

(57) ABSTRACT

A massaging mattress assembly for massaging various parts of a user's body while lying down. The massaging mattress assembly includes a mattress that has a top, a head end, and a plurality of slots that are spacedly disposed in the top. A headrest assembly is removably attached to the head end of the mattress. A roller assembly is disposed in the slots of the mattress. The roller assembly includes base members that are disposed in the slots and also includes ball members upon which a user lies. A vibrating assembly is disposed in said mattress.

13 Claims, 5 Drawing Sheets

MASSAGING MATTRESS ASSEMBLY

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to mattresses and, more particularly, to a massaging mattress assembly for massaging various parts of a user's body while lying down.

2. Prior Art

Many persons are familiar with the aches and pains that are caused by being seated in one position for extended periods of time. This is particularly true of individuals who are employed in an office where they spend hours seated in a chair while answering the phone or working on a computer. It is not only stationary persons that suffer from muscle aches and pains though. Many laborers like carpenters and construction workers develop severe back and neck pains that are believed to be caused by the constant bending and extending that is required during a regular days work. If such aches and pains are left unattended they can develop into a debilitating and chronic health issue that severely limits the person's working ability.

Some persons are able to consult a health professional, like a masseuse or a chiropractor, who can offer them some relief by administering certain treatments. These treatments, however, are time consuming and time must be made to attend them, which may be impossible for some individuals. Furthermore, not all persons are able to afford the bills associated with a professional masseuse or a chiropractor, especially if their health insurance does not provide compensation for such services.

In response to this problem various soothing muscle massaging apparatuses for personal and home use have been introduced in the prior art. Some of these unfortunately require the presence of another person in order to be effectively used, which can be inconvenient. Other apparatuses have been conceived with the intention to be used by the person who is afflicted with the muscle aches and pains. However, due to a shortcoming in the design or the due to the extent of the person's discomfort, these apparatuses are not capable of reaching all the pain afflicted areas.

Accordingly, a need remains for a massaging mattress assembly in order to overcome the above-noted shortcomings. The present invention satisfies such a need by providing a massaging mattress assembly that is convenient and easy to use, practical and effective in design, has therapeutic qualities, and has an eye-catching design. Such an assembly massages and sooths sore muscles, relieves tension, and improves circulation in the body, which is vital for preventing sore muscles. The assembly allows a person to enjoy a complete and fulfilling massage with minimal effort. The height adjustable rollers thereof allow an individual to easily target virtually any pain afflicted area of the body. The assembly also eliminates the need for and the hassle associated with going to a professional masseuse or a chiropractor, which can become costly. Such a massaging mattress assembly finds particular appeal among persons with muscle pains due to work or injury, and also among arthritis sufferers.

BRIEF SUMMARY OF THE INVENTION

In view of the foregoing background, it is therefore an object of the present invention to provide a massaging mattress assembly. These and other objects, features, and advantages of the invention are provided by a massaging mattress assembly for massaging various parts of a user's body while lying down.

The massaging mattress assembly includes a mattress that has a top, a head end, and a plurality of slots that are spacedly disposed in the top. A headrest assembly is removably attached to the head end of the mattress. A roller assembly is disposed in the slots of the mattress. The roller assembly includes base members that are disposed in the slots and also includes ball members upon which a user lies. A vibrating assembly is disposed in said mattress.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
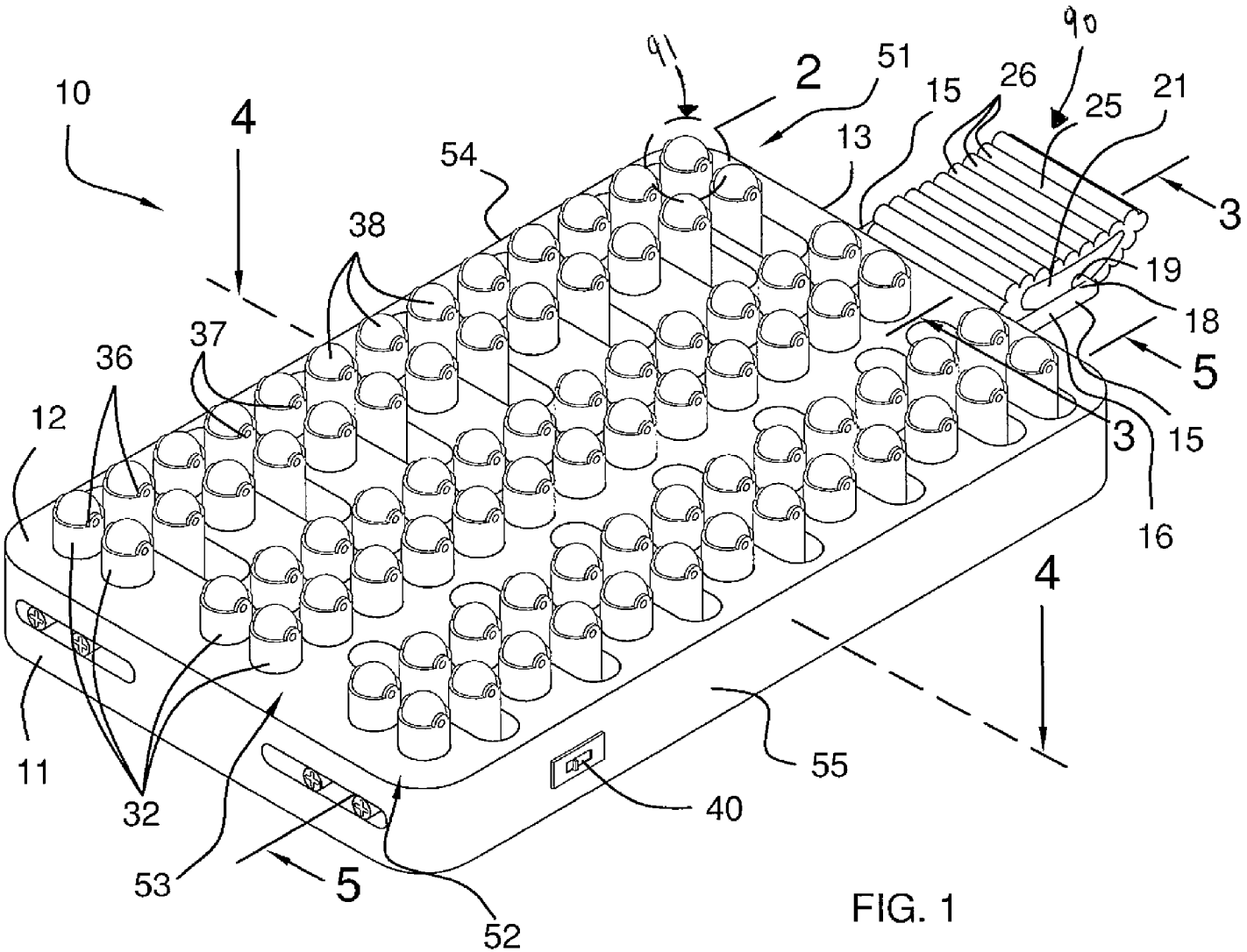
FIG. 1 is a perspective view showing a massaging mattress assembly, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The assembly of this invention is referred to generally in FIGS. 1-5 by the reference numeral 10 and is intended to provide a mattress massaging assembly. It should be understood that the assembly 10 may be used to massage many different types of muscle groups and should not be limited in use to only massaging the muscle groups found in one's neck and back.

Referring initially to FIGS. 1, 3, 4 and 5, the massaging mattress assembly 10 includes a mattress 11 that has a top 12, a head end 13, and a plurality of slots 14 that are spacedly disposed in the top thereof. A headrest assembly 90 is removably attached to the head end 13 of the mattress 11. Such a headrest assembly 90 includes elongate support members 15 that have first ends 17 that are securely attached to the head end 13 of the mattress 11. The headrest assembly 90 also includes an axle member 20 that is securely attached at second ends 19 of the elongate support members 15 and a cushion support member 21 that is mounted about the axle member 20.

The headrest assembly 90 also includes a cushion member 25 that is disposed about the cushion support member 21. A cover 27 is disposed about the cushion member. Each elongate support member 15 has a main portion 16 and a second end portion 18 which is angled relative to the main portion 16. The cushion support member 21 has a body which has an arcuate bottom 22, a slightly beveled top 23, and side walls 24 with the axle member 20 disposed through the side walls 24 thereof. The cushion member 25 has a laterally-ribbed outer surface 26.

Figure 2:
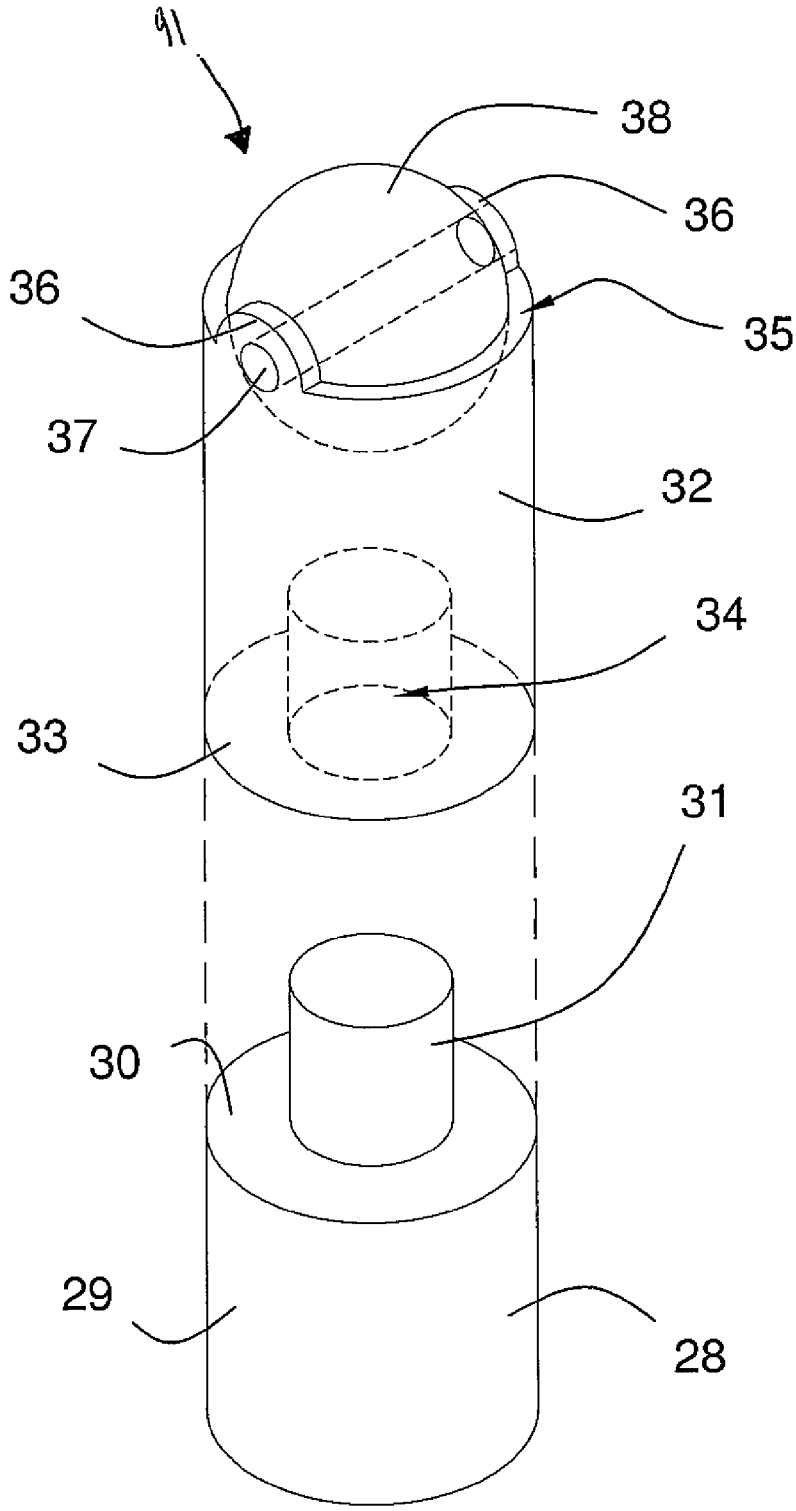
FIG. 2 is an exploded perspective view of the roller assembly shown in FIG. 1, taken from section 2.
Figure 3:
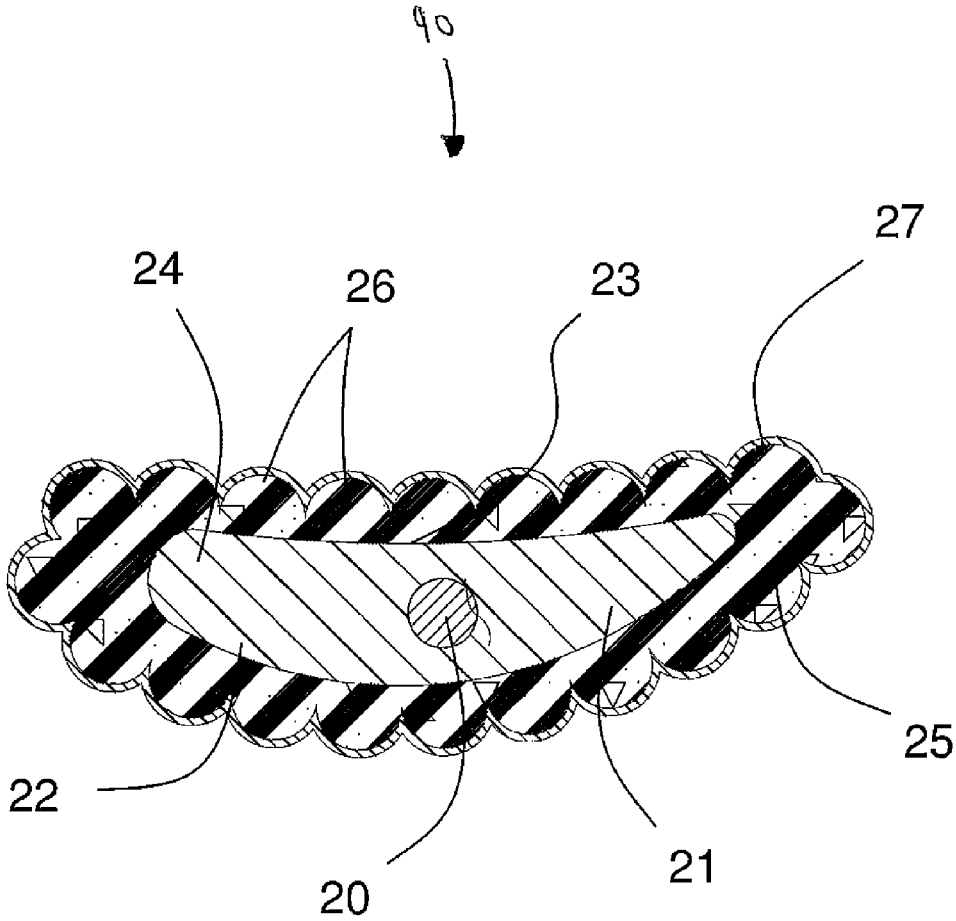
FIG. 3 is a cross-sectional view of the headrest assembly shown in FIG. 1, taken along line 3-3.
Figure 4:
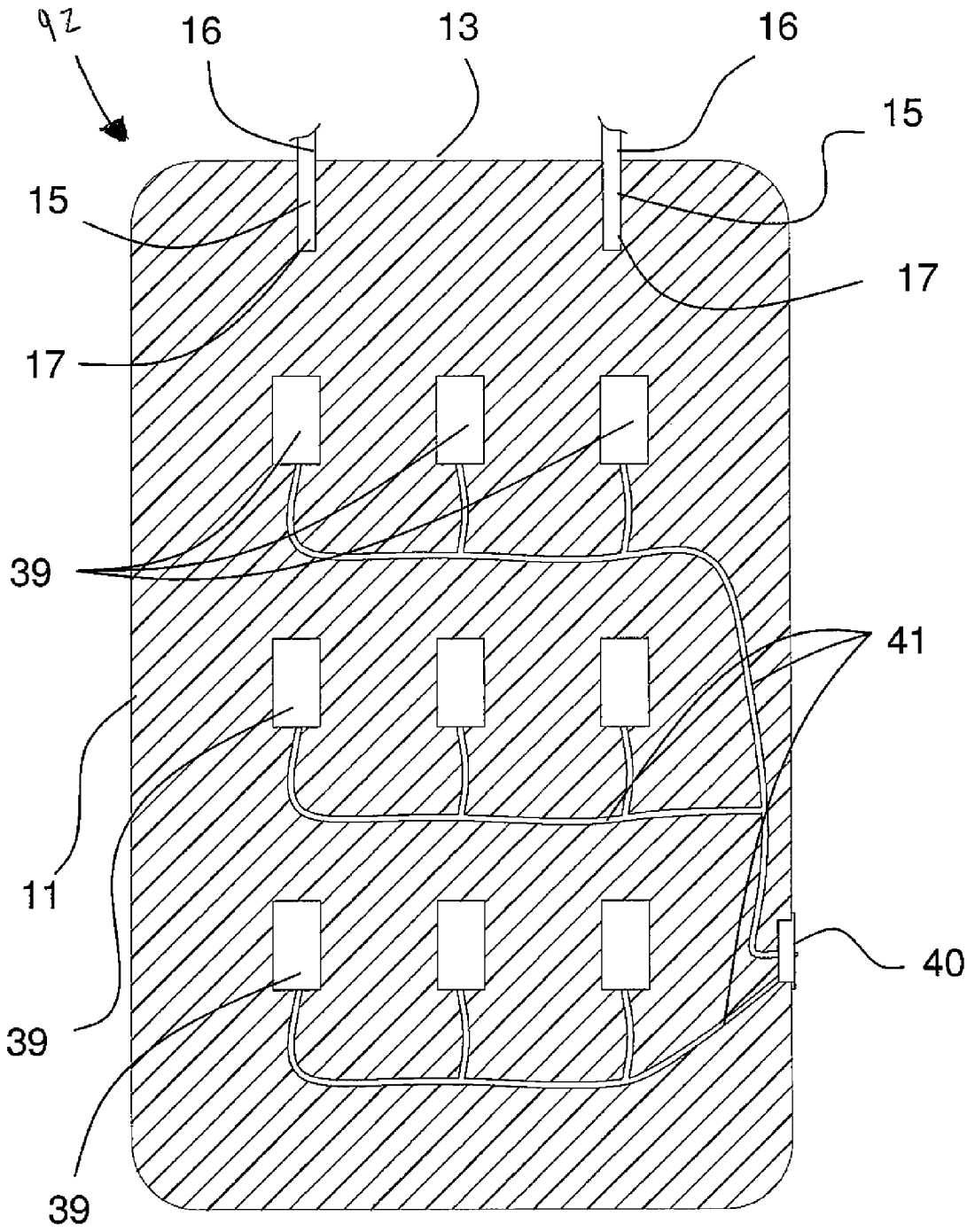
FIG. 4 is a cross-sectional view of the mattress massaging assembly shown in FIG. 1, taken along line 4-4.
Figure 5:
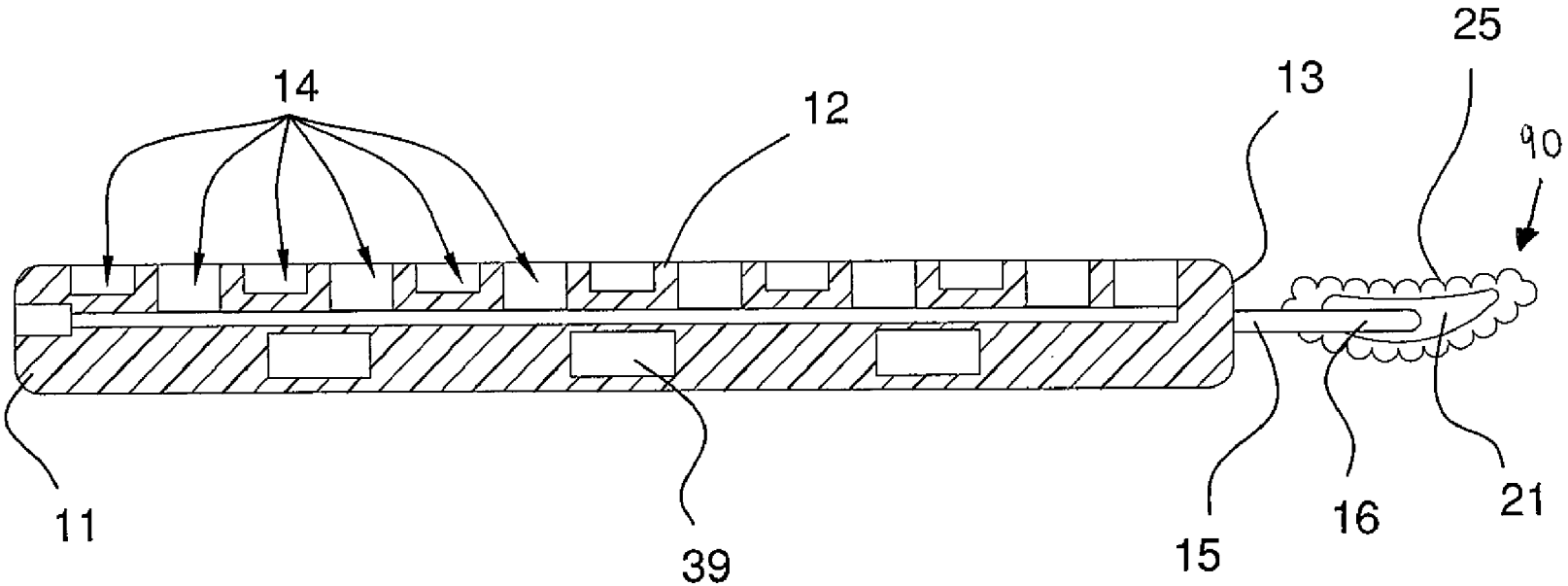
FIG. 5 is a cross-sectional view of the mattress massaging assembly shown in FIG. 1, taken along line 5-5.

Referring to FIGS. 1, 2 and 5, a roller assembly 91 is disposed in the slots 14 of the mattress 11 and includes base members 28 that are disposed in the slots 14 and also include ball members 38 upon which a user lies. The roller assembly 91 further includes roller support members 32 that are removably mounted upon the base members 28 and also include axles 37 that are attached to the roller support members 32. Each of the base members 28 includes a cylindrical portion 29 that has a top wall 30. Such base members 28 also include a boss portion 31 that is disposed upon the top wall 30 of the cylindrical portion 29.

Each of the roller support members 32 are cylindrically-shaped and has a bottom wall 33. A circular hole 34 is disposed in the bottom wall 33 and is adapted to receive the boss portion 31 of a respective base member 28. Each roller support member 32 also has an open top 35 and a pair of lugs 36 that are diametrically opposed and are disposed upon a top edge of a side wall of the roller support member 32. The axle 37 is rotatably disposed in the lugs 36. The ball members 38 are rotatably mounted about the axles 37 and are disposed in the open tops 35 of the roller support members 32.

A vibrating assembly 92 is disposed in the mattress 11 for vibrating the mattress 11. The vibrating assembly 92 includes a plurality of conventional vibrators 39 that are spacedly disposed in the mattress 11. Such a vibrating assembly 92 also includes an on/off switch 40 that is attached to an exterior side of the mattress 11 and is connected with wires 41 to the vibrators 39 and is connectable to a power source.

Referring back to FIG. 1, the plurality of roller support members 32 are juxtaposed along a plurality of rectilinear rows defined along a longitudinal length of the mattress 11. A first pair of the roller support member rows 51 are linearly situated adjacent a first longitudinal outer edge 54 of the mattress 11. A second pair of the roller support members rows 52 are linearly situated adjacent a second longitudinal outer edge 55 of the mattress 11. The first and second pairs of roller support member rows 51, 52 travel parallel to the first and second outer edges 54, 55 respectively wherein the first and second pairs of roller support member rows 51, 52 are equidistantly spaced from a centrally registered longitudinal axis of the mattress 11.

A third pair of the roller support members rows 53 are centrally oriented with the longitudinal axis of the mattress 11 and medially spaced between the first and second pair of roller support member rows 51, 52, respectively. The third pair of roller support member rows 53 are statically affixed to the mattress 11 while the first and second pair of roller support member rows 51, 52 are laterally adaptable along a linear path defined orthogonal to the longitudinal axis of the mattress 11.

In use, the user lies upon the mattress 11 and upon the ball members 38 and moves upon the mattress 11 with the ball members 38 massaging the various parts of the user's body as the user moves about. Also, the user can turn on the vibrators 39 while lying upon the matters 11 which would also facilitate massaging one's body.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A massaging mattress comprising:

a mattress having a top, a head end, and a plurality of slots being spacedly disposed in said top thereof;

a headrest assembly being removably attached to said head end of said mattress;

a plurality of roller assemblies being disposed in said slots of said mattress, each of said roller assemblies including a base member being disposed in one of said slots and also including a ball member adapted upon which a user lies; and a vibrating assembly being disposed in said mattress;

wherein said roller assembly further includes roller support members being removably mounted upon said base members, and also includes axles being attached to said roller support members;

wherein each of said base members includes a cylindrical portion having a top wall, and also includes a boss portion being disposed upon said top wall of said cylindrical portion;

wherein each of said roller support members is cylindrically-shaped and has a bottom wall, a circular hole being disposed in said bottom wall and being adapted to receive said boss portion of a respective base member, each of said roller support members also having an open top and pair of lugs being diametrically opposed and being disposed upon a top edge of a side wall of said roller support member, said axle being rotatably disposed in said lugs, said ball members being mounted about said axles and being disposed in said open tops of said roller support members.

2. The assembly of claim 1, wherein said headrest assembly includes elongate support members having first ends being securely attached to said head end of said mattress, and also includes an axle member being securely attached at second ends of said elongate support members, and further includes a cushion support member being mounted about said axle member, and also includes a cushion member being disposed about said cushion support member, and further includes a cover being disposed about said cushion member.

3. The assembly of claim 2, wherein each of said elongate support members has a main portion and a second portion which is angled relative to said main portion.

4. The assembly of claim 2, wherein said cushion support member has a body which has an arcuate bottom, a slightly beveled top, and side walls with said axle member being disposed through said side walls thereof.

5. The assembly of claim 2, wherein said cushion member has a laterally-ribbed outer surface.

6. The assembly of claim 1, wherein said vibrating assembly includes a plurality of conventional vibrators being spacedly disposed in said mattress, and also include an on/off switch being attached to an exterior side of said mattress and being connected with wires to said vibrators and being connectable to a power source.

7. The assembly of claim 1, wherein said roller assembly comprises:

a plurality of roller support members juxtaposed along a plurality of rectilinear rows defined along a longitudinal length of said mattress, a first pair of said roller support member rows being linearly situated adjacent a first longitudinal outer edge of said mattress, a second pair of said roller support members rows being linearly situated adjacent a second longitudinal outer edge of said mattress, said first and second pairs of roller support member rows traveling parallel to said first and second outer edges respectively wherein said first and second pairs of roller support member rows are equidistantly spaced from a centrally registered longitudinal axis of said mattress, a third pair of said roller support members rows are centrally oriented with the longitudinal axis of said mattress and medially spaced between said first and second pair of roller support member rows respectively, said third pair of roller support member rows being statically affixed to said mattress.

8. A massaging mattress assembly comprising:

a mattress having a top, a head end, and a plurality of slots being spacedly disposed in said top thereof;

a headrest assembly being removably attached to said head end of said mattress;

a plurality of roller assemblies being disposed in said slots of said mattress, each of said roller assemblies including a base member being disposed in one of said slots and also including a ball member adapted upon which a user lies; and a vibrating assembly being disposed in said mattress;

wherein said headrest assembly comprises a plurality of elongate support members having first ends being securely attached to said head end of said mattress, an axle member being securely attached at second ends of said elongate support members, a cushion support member being mounted about said axle member, a cushion member being disposed about said cushion support member, and a cover being disposed about said cushion member, wherein said roller assembly further includes roller support members being removably mounted upon said base members, and also includes axles being attached to said roller support members;

wherein each of said base members includes a cylindrical portion having a top wall, and also includes a boss portion being disposed upon said top wall of said cylindrical portion;

wherein each of said roller support members is cylindrically-shaped and has a bottom wall, a circular hole being disposed in said bottom wall and being adapted to receive said boss portion of a respective base member, each of said roller support members also having an open top and pair of lugs being diametrically opposed and being disposed upon a top edge of a side wall of said roller support member, said axle being rotatably disposed in said lugs, said ball members being mounted about said axles and being disposed in said open tops of said roller support members.

9. The assembly of claim 8, wherein each of said elongate support members has a main portion and a second portion which is angled relative to said main portion.

10. The assembly of claim 8, wherein said cushion support member has a body which has an arcuate bottom, a beveled top, and side walls with said axle member being disposed through said side walls thereof.

11. The assembly of claim 8, wherein said cushion member has a laterally-ribbed outer surface.

12. The assembly of claim 8, wherein said vibrating assembly includes a plurality of conventional vibrators being spacedly disposed in said mattress, and also include an on/off switch being attached to an exterior side of said mattress and being connected with wires to said vibrators and being connectable to a power source.

13. The assembly of claim 8, wherein said roller assembly comprises:

a plurality of roller support members juxtaposed along a plurality of rectilinear rows defined along a longitudinal length of said mattress, a first pair of said roller support member rows being linearly situated adjacent a first longitudinal outer edge of said mattress, a second pair of said roller support members rows being linearly situated adjacent a second longitudinal outer edge of said mattress, said first and second pairs of roller support member rows traveling parallel to said first and second outer edges respectively wherein said first and second pairs of roller support member rows are equidistantly spaced from a centrally registered longitudinal axis of said mattress, a third pair of said roller support members rows are centrally oriented with the longitudinal axis of said mattress and medially spaced between said first and second pair of roller support member rows respectively, said third pair of roller support member rows being statically affixed to said mattress.

* * * * *